United States Patent [19]

Scholl et al.

[11] Patent Number: 5,027,976

[45] Date of Patent: Jul. 2, 1991

[54] MULTI-ORIFICE T-BAR NOZZLE

[75] Inventors: Charles H. Scholl; John T. Walsh, both of Duluth, Ga.

[73] Assignee: Nordson Corporation, Westlake, Ohio

[21] Appl. No.: 418,508

[22] Filed: Oct. 10, 1989

[51] Int. Cl.[5] ..... B67B 7/00

[52] U.S. Cl. ..... 222/1; 222/146.5; 239/135; 425/549

[58] Field of Search ..... 222/146.2, 146.5, 1; 239/1, 135; 219/421; 425/548-549

[56] References Cited

U.S. PATENT DOCUMENTS

| | | | |
|---|---|---|---|
| 3,653,552 | 4/1972 | Ash | 222/146.5 |
| 3,758,001 | 9/1973 | Callan | 222/146.5 |
| 3,827,604 | 8/1974 | Hamilton et al. | 222/146.5 |
| 3,841,567 | 10/1974 | Drozek et al. | 239/570 |
| 4,026,440 | 5/1977 | Crum et al. | 222/146.2 |
| 4,544,085 | 10/1985 | Frazer | 222/146.4 |
| 4,602,741 | 7/1986 | Faulkner et al. | 239/135 |
| 4,659,016 | 4/1987 | Faulkner | 239/135 |
| 4,721,252 | 1/1988 | Colton | 239/424.5 |
| 4,844,003 | 7/1989 | Slautterback et al. | 118/323 |

OTHER PUBLICATIONS

Technical Bulletin No. TB029, "Multi-Orifice Nozzles", Slautterback Corporation, Oct. 1987.

"E-700 Electric Gun", No. 306-18-868, Nordson Corporation, Aug., 1989.

*Primary Examiner*—Kevin P. Shaver

*Assistant Examiner*—Gregory L. Huson

*Attorney, Agent, or Firm*—Wood, Herron & Evans

[57] ABSTRACT

A multi-orifice T-bar nozzle includes a nozzle body having a mounting plate adapted to connect to the body of a hot melt thermoplastic adhesive dispenser, and an internal adhesive flow path formed by an inlet at the top wall of the nozzle body adapted to receive adhesive from the adhesive dispenser, a number of outlets at the bottom wall thereof which extrude adhesive beads and a distribution passageway interconnecting the inlet and outlets. The nozzle body progressively tapers from the top, center portion thereof to its extremities, i.e., to the end portions and bottom of the nozzle body, so that the temperature differential between the adhesive entering the inlet of the nozzle body, and the adhesive discharged from the outlets, is minimized.

27 Claims, 1 Drawing Sheet

MULTI-ORIFICE T-BAR NOZZLE

FIELD OF THE INVENTION

This invention relates to adhesive dispensing devices, and, more particularly, to a multi-orifice T-bar-type nozzle adapted to mount to the body of a hot melt adhesive dispensing device.

BACKGROUND OF THE INVENTION

Hot melt thermoplastic adhesives have been widely used in industry for adhering many types of products, and are particularly useful in applications where quick setting time is advantageous. One application for hot melt adhesives which has been of considerable interest in recent years is in the cartoning and packaging industry. Hot melt adhesive beads are extruded through nozzles onto the major and/or minor flaps of a carton or package traveling at a high rate of speed, and then the flaps are subsequently folded together to effect a bond therebetween. A wide variety of packages and cartons are formed in this manner, including those requiring a "sift-proof" seal between the flaps, i.e., one in which all leakage paths through the flap connections are eliminated.

In order to ensure that the flaps of a carton are securely bonded to one another, it is desirable to apply an adhesive pattern consisting of extruded beads which extend transversely or at right angles to one another on the major and minor flaps of the cartons. This involves the application of one or more extruded beads onto a major or minor flap in the direction of movement of the carton or package, and at least one extruded bead along the flaps in a direction transverse, i.e., perpendicular or angulated, with respect to the direction of the substrate movement. In many cartoning or packaging applications it is necessary to deposit either a continuous bead, or a number of laterally spaced beads, across substantially the entire width of the flaps which are transverse to the direction of movement of the carton to obtain the desired bond.

One structure which has been employed in cartoning and packaging applications to apply a number of laterally spaced beads to the transverse flaps of a carton is a "T-bar" nozzle such as disclosed, for example, in U.S. Pat. No. 4,659,016 to Faulkner. The T-bar nozzle disclosed in the Faulkner U.S. Pat. No. 4,659,016, and other nozzles of this type, comprises a rectangular-shaped nozzle body or bar formed with an inlet, an internal distribution passageway and a number of spaced outlets or orifices each supporting a discharge nozzle. The nozzle body is mounted to the housing of an adhesive dispenser such that hot melt adhesive is ejected from the dispenser into the inlet of the nozzle body and transmitted through its internal distribution passageway to each of the outlets. These outlets direct the hot melt adhesive into the discharge nozzles, each of which extrude a separate adhesive bead for deposition onto a substrate. In a cartoning application, a T-bar nozzle of this type can be positioned with respect to a transverse flap of the moving carton so that it dispenses a number of extruded beads which are laterally spaced along substantially the entire width of such transverse flap.

While the construction of T-bar nozzles of the type described above lends itself to the formation of cartons and packages, a number of problems have been encountered with their use in such application. One problem involves imprecise cut-off of the adhesive flow through the nozzle which produces undesired drooling or stringing of the adhesive onto the nozzle and/or substrate. It can be appreciated that the T-bar nozzle must be operated intermittently as the flaps of individual cartons are moved therepast at relatively high line speeds. It is believed that a relatively high amount of adhesive is allowed to pool within the inlet, distribution passageway and outlets of the rectangular nozzle body of T-bar nozzles such as disclosed in the Faulkner U.S. Pat. No. 4,659,016, and this excess adhesive escapes or drools from the discharge outlets of the T-bar nozzle when the flow of adhesive from the dispensing device into the nozzle inlet is intermittently interrupted or cut off during a production run.

Another cause of drooling or stringing of adhesive from T-bar nozzles is that a relatively high temperature differential is created between the adhesive ejected from the dispensing device into the inlet of the nozzle and the adhesive which is ejected from the discharge outlets thereof. In the T-bar nozzle disclosed in U.S. Pat. No. 4,659,016, for example, a temperature drop of from about 20° to 90° F. can be created between the adhesive in the dispensing device and the adhesive which is ejected from its discharge orifices or outlets. This substantial temperature differential is undesirable because it permits stringing or drooling of the adhesive, i.e., the discharge of thin adhesive strands or "angel hair" from the outlets of the T-bar nozzle. The formation of adhesive strands can result in a glue build-up on the packaging machine, thus requiring a shut down of the packaging or cartoning line for cleaning and maintenance.

SUMMARY OF THE INVENTION

It is therefore among the objectives of this invention to provide a multi-orifice T-bar nozzle which provides for precise cut-off of the adhesive flow therethrough and which substantially reduces drool or stringing of adhesive.

These objectives are accomplished in a T-bar nozzle adapted for use with an adhesive dispenser which comprises a nozzle body having an inlet at the top of the nozzle body, an internal, distribution passageway and a number of longitudinally spaced discharge outlets at the bottom of the nozzle body each connected to the distribution passageway. A mounting plate is integrally formed with or fixedly attached to the top of the nozzle body and is adapted to connect directly to the body of an adhesive dispenser device in position to permit the transfer of heated hot melt adhesive from the dispensing device into the inlet of the nozzle body and then through the internal passageway to the discharge outlets for deposition onto a substrate. The nozzle body has a configuration which progressively requires less heat to be transferred through the nozzle body in the course of passage of the heated hot melt adhesive through the inlet, internal distribution passageway and discharge outlets, in order to obtain a minimal drop between the temperature of the adhesive at the inlet to the nozzle body and the temperature of the adhesive at the discharge outlets.

In the presently preferred embodiment, the mounting plate of the T-bar nozzle is directly connected to the body of the adhesive dispenser at a location proximate a heater carried within the dispenser body. Heat from the dispenser body is transferred by conduction to the integral mounting plate, which, in turn, transfers heat directly to the body of the T-bar nozzle. The T-bar nozzle body comprises a relatively wide top wall on either side of the mounting plate, a comparatively narrow bottom wall, opposed end walls and opposed side walls each having an upper portion and a lower portion. The top wall of the nozzle body tapers from the mounting plate to the end walls, in a downward direction toward the bottom wall, so that less mass and surface area is present at the ends of the nozzle body than at its center. Additionally, at least a portion of both side walls taper inwardly, toward one another, to the narrow bottom wall. Because the width of the bottom wall is substantially less than that of the top wall, there is much less mass and surface area at the bottom portion of the nozzle body than at the top portion.

The configuration of the T-bar nozzle body of this invention is specifically intended to minimize the temperature drop between the adhesive entering the inlet at the top wall of the nozzle body from the adhesive dispenser, and the adhesive which is ejected from the discharge outlets into discharge nozzles located at the bottom wall of the nozzle body. By connecting the mounting plate directly to the body of the adhesive dispenser, proximate a heater in the adhesive dispenser, good thermal heat transfer is provided to the T-bar nozzle. Substantial mass and surface area of the T-bar nozzle is concentrated where the mounting plate connects thereto which further enhances the transfer of heat from the adhesive dispenser to the remainder of the nozzle body. As the adhesive travels from the inlet into the distribution passageway and then to the discharge outlets of the nozzle body, some heat loss is unavoidable. This heat loss is minimized, however, by the reduction in mass and surface area of the nozzle body as the adhesive travels further from the inlet at the top wall of the nozzle body where the temperature of the adhesive is maximum, to the bottom wall where the discharge outlets are formed. The progressively lesser mass and surface area of the nozzle body in moving from the inlet to the discharge outlets reduces the area through which heat loss from the adhesive can occur. As a result, the temperature of adhesive at the inlet to the nozzle body is about the same as that within the dispenser device, and the temperature of the adhesive ejected from the discharge outlets of the nozzle body is not significantly less than the temperature at the inlet. This reduces stringing or drooling of the adhesive, particularly where the T-bar nozzle is operated intermittently in applications such as in the cartoning and packaging industry.

Another important aspect of t is invention is that drooling and stringing of adhesive is further limited by minimizing the quantity of adhesive within the nozzle body. This is achieved by forming the inlet, distribution passageway and discharge outlets with relatively small diameters and eliminating any adhesive chambers or other areas within the nozzle body where adhesive can pool. In the presently preferred embodiment, the inlet is about 0.040 inches in diameter. If less than four outlets are formed in the nozzle body, the internal distribution passageway is preferably about 0.040 inches in diameter. Where more than four discharge outlets are formed in the nozzle body, the distribution passageway is preferably about 0.060 inches in diameter.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 3:
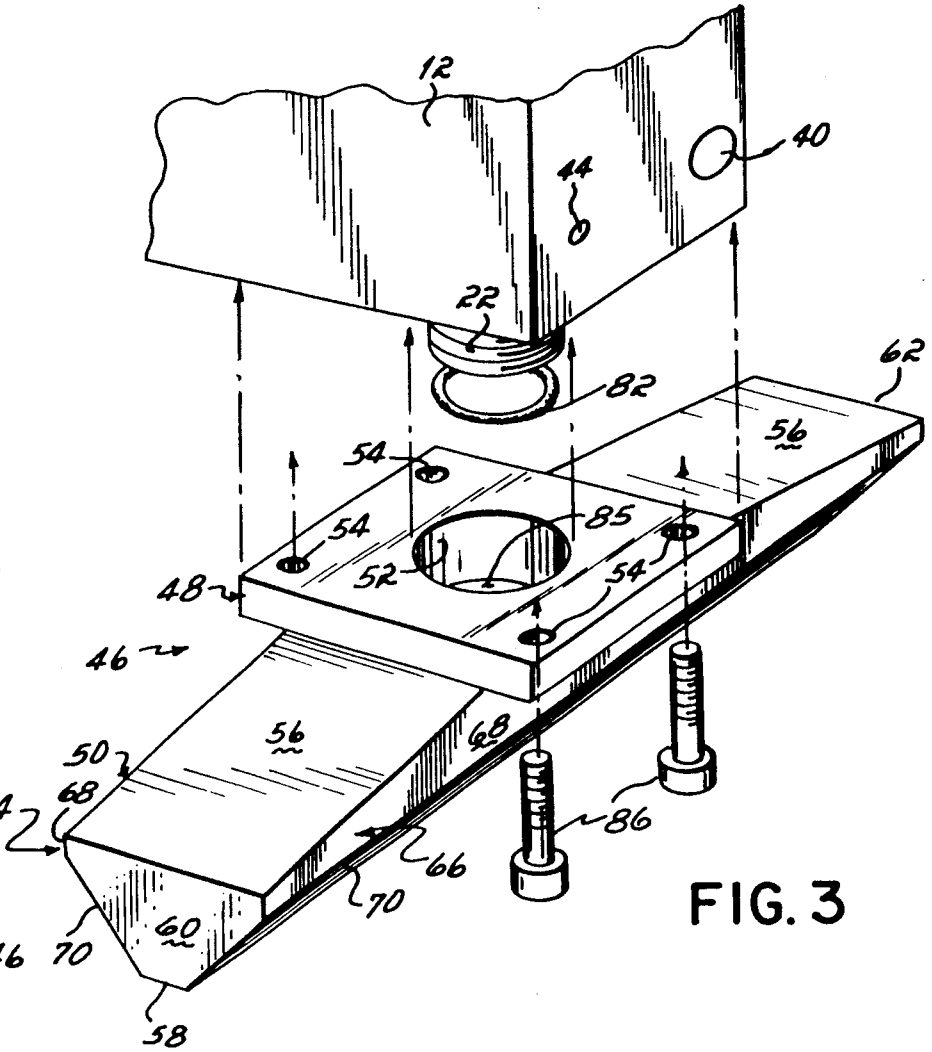
FIG. 3 is a schematic, disassembled perspective view of the T-bar nozzle and the base of the adhesive dispenser.

Referring now to the FIGS., an adhesive dispenser 10 is illustrated having a dispenser body 12 which is supported on a mounting rod 14 by a mounting block 16. The dispenser body 12 is formed with an adhesive passageway 18 connected by a line 20 to a source of heated, hot melt thermoplastic adhesive (not shown). The adhesive passageway 18 extends to the base of the dispenser body 12 where an extension 22 is mounted having an adhesive chamber 24 connected to an adhesive discharge orifice 26.

A plunger 28 is located within the adhesive passageway 18, and has a ball 30 at its lower end which is shaped to engage a seat 32 mounted within the extension 22 between its adhesive chamber 24 and adhesive discharge orifice 26. The plunger 28 is axially movable within passageway 18 by operation of a solenoid 34 which is mounted within the dispenser body 12 by a sleeve 35. The solenoid 34 is energized by an electric lead 36 connected by a line 38 from a power supply (not shown). In response to operation of the solenoid 34, the plunger 28 is axially movable within the adhesive passageway 18 between a closed position as shown in FIG. wherein the ball 30 engages the seat 32 to prevent the passage of adhesive into the discharge orifice 26, and an open position wherein the ball 30 disengages the seat 3 to permit the flow of adhesive from the adhesive chamber 24 into adhesive discharge orifice 26.

Figure 2:
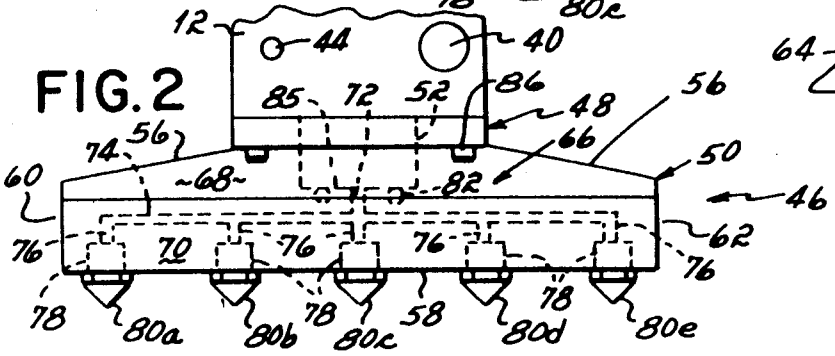
FIG. 2 is a side view of the T-bar nozzle and a portion of the adhesive dispenser taken generally along line 2—2 of FIG. 1.

In the presently preferred embodiment, a heating element 40 is mounted near the base of the dispenser body 12 and is connected by an electrical lead 42 to the power supply line 38. As shown in FIG. 2, an RTD 44 is carried within the dispenser body 12 near the heating element 40 which is effective to sense the temperature of the dispenser body 12 thereat and permit adjustment of the current to heating element 40 so that the hot melt adhesive within the adhesive passageway 18 can be heated to the desired temperature.

A multi-orifice, T-bar nozzle 46 is adapted to mount to the adhesive dispensing device 10 to receive molten hot melt adhesive therefrom and to dispense a plurality of extruded adhesive beads. The T-bar nozzle 46 includes a mounting plate 48 integrally formed with or fixedly connected to the nozzle body 50 of the T-bar nozzle 46. The mounting plate 48 is formed of a heat conductive material such as metal and is generally square in shape having a central bore 52 and a mounting bore 54 at each corner. The mounting plate 48 is positioned at the top and center of the nozzle body 50 which comprises a top wall 56, a narrow bottom wall 58, opposed end walls 60, 62, and opposed side walls 64, 66 each having an upper portion 68 and a lower portion 70.

The nozzle body 50 tapers in all directions from its center portion, i.e., where the mounting plate 48 is formed, to the extremities. As viewed in FIGS. 2 and 3, the top wall 56 tapers downwardly, i.e., toward the bottom wall 58, from the mounting plate 48 to the end walls 60, 62. As a result, the mass and surface area of the nozzle body 50 at its top and center, where the mounting plate 48 is located, is less than that at the extremities of the top wall 56 near the end walls 60, 62. Additionally, the upper portion 68 of each side wall 64, 66 extends vertically downwardly from the top wall 56, and the lower portion 70 of such side walls 64, 66 tapers or angulates inwardly from the upper portion 68 to the narrow bottom wall 58. The mass and surface area of the nozzle body 58 therefore substantially decreases in moving vertically downwardly from the top wall 56 along the tapered side walls 64, 66 to the narrow bottom wall 58.

Figure 1:
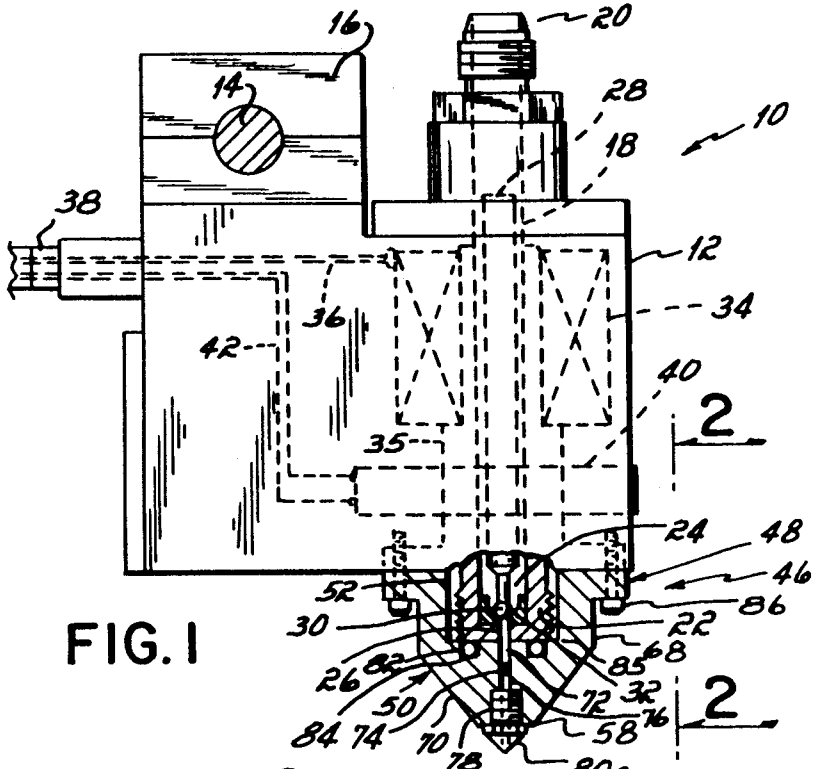
FIG. 1 is a schematic view in partial cross section of the T-bar nozzle of this invention mounted to an adhesive dispenser.

As best shown in FIGS. 1 and 2, the nozzle body 50 is formed with an inlet 72 which extends inwardly from the surface 85 thereof and is connected to a longitudinally extending, internal distribution passageway 74. In the illustrated embodiment, five orifices or outlets 76 are connected at spaced intervals along the length of the distribution passageway 74. Each of these outlets 76 extend into a mounting port 78 located at the bottom wall 58 of nozzle body 50, and these mounting ports 78 carry discharge nozzles 80*a–e*, respectively, which are effective to eject extruded beads of adhesive onto a substrate.

In the presently preferred embodiment, the size of the inlet 72, distribution passageway 74 and outlet 76 are maintained as small as possible to avoid pooling or retention of adhesive within the nozzle body 50. In embodiments wherein less than four discharge nozzles 80 are employed, the distribution passageway 74 is preferably about 0.040 inches in diameter. In the event four or more discharge nozzles 80 are required, as in the illustrated embodiment, the diameter of the distribution passageway 74 is preferably about 0.060 inches. The inlet 72 preferably has a diameter of about 0.040 inches in all embodiments.

As best shown in FIGS. 1 and 3, the T-bar nozzle 46 is attached to the body 12 of dispensing device 10 by placing the mounting plate 48 directly into contact with the base of the dispenser body 12 such that the extension 22 enters the central bore 52 of mounting plate 48 and engages an O-ring 82 carried within an annular groove 84 formed in the surface 85 at the bottom of bore 52. Four screws 86 are inserted through the mounting bores 54 of the mounting plate 48 to secure the T-bar nozzle 46 and the sleeve 35 to the dispenser body 12. In the assembled position shown in FIG. 1, the adhesive discharge orifice 26 of extension 22 connects to the inlet 72 of nozzle body 50 to permit the passage of hot melt adhesive from the adhesive chamber 24 and discharge orifice 26 of extension 22 into the inlet 72 of nozzle body 50. The adhesive is transmitted through the inlet 72, into the distribution passageway 74 and then through each of the outlets 76 to the discharge nozzles 80*a–e*.

As mentioned above, the configuration of the nozzle body 50 is effective to substantially minimize the temperature differential of the adhesive entering the inlet 72 of nozzle body 50 and the adhesive ejected from the discharge nozzles 80*a–e*. As seen in the FIGS., substantial mass and surface area is provided in the nozzle body 50 at the top center portion thereof where the mounting plate 48 is located. Heat from the dispenser body 12 is transferred from the dispenser body 12 to the mounting plate 48 and the top, center portion of nozzle body 50, which, because of their substantial mass and surface area, readily conduct the heat away from the dispenser body 12 into the remainder of the nozzle body 50. Because the mass and surface area of the nozzle body 50 progressively decreases in moving from the top, center portion thereof to the end walls 60, 62 and bottom wall 58, less heat is required to be transferred through the nozzle body 50 as the adhesive moves through the distribution passageway 74 and outlets 76 to the discharge nozzles 80*a–e*. As a result, the temperature differential between the adhesive at the inlet 72 of nozzle body 50 and the discharge nozzles 80*a–e* is minimized.

Experiments have been conducted with the T-bar nozzle 46 of this invention and the T-bar nozzle similar to that disclosed in U.S. Pat. No. 4,659,016 to Faulkner. In these experiments, measurements were taken of the temperature of the hot melt adhesive within the interior of an adhesive dispenser which mounts the T-bar nozzle and at the outermost nozzles at the bottom wall of the nozzle, i.e., those in the position of discharge nozzles 80*a* and 80*e* in the FIGS. which are located furthest from the center or inlet to the T-bar nozzle.

In one experiment, adhesive was allowed to flow through the T-bar nozzle 46 of this invention and the T-bar nozzle disclosed in Faulkner U.S. Pat. No. 4,659,016 under static air flow conditions, i.e., without movement of any air past the T-bar nozzles such as would occur with the use of such nozzles in applying adhesive onto moving cartons or packages in a cartoning line. In the T-bar nozzle 46 of this invention, the temperature of the adhesive within the dispenser body 12 of dispensing device 10 was measured to be in the range of about 3° to 8° F. higher than the adhesive discharged from discharge nozzles 80*a* and 80*e* as viewed in FIG. 2. In the T-bar nozzle disclosed in U.S. Pat. No. 4,659,016 to Faulkner, the temperature differential between the adhesive at these same locations was found to be in the range of about 23° to 27° F. This experiment indicates that the temperature drop of the adhesive obtained in the T-bar nozzle 46 of this invention, under static air flow conditions, is substantially less than that obtained by the T-bar nozzle disclosed in Faulkner U.S. Pat. No. 4,659,016.

A second experiment was conducted with the same two T-bar nozzles under conditions in which air was blown over each dispensing device and T-bar nozzle to simulate a production environment, i.e., wherein air is passed over the dispensing devices and nozzles such as by the movement of cartons or packages therepast. In this experiment, no adhesive was discharged through the T-bar nozzles, and temperature measurements of the adhesive were taken at the same locations, i.e., within the interior of each dispensing device and at the outermost discharge nozzles. Under these conditions, it was found that the temperature differential of the adhesive within the dispenser body 12 and outermost nozzles 80*a*, *e* of the T-bar nozzle 46 of this invention was in the range of approximately 53° to 54° F. In the Faulkner T-bar nozzle disclosed in U.S. Pat. No. 4,659,016, measurements taken at these same locations indicated that the temperature of the adhesive at the discharge nozzles was in the range of about 88° to 91° F. less than the temperature of the adhesive within the associated adhesive dispenser. It is believed that such a large temperature differential can contribute substantially to the formation of strands or strings of adhesive, as well as drool, in the intermittent operation of the Faulkner T-bar nozzle.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the T-bar nozzle 46 of this invention is illustrated in combination with a solenoid-operated adhesive dispensing device 10. It should be understood, however, that a pneumatically operated dispensing device could be adapted for use with the T-bar nozzle 46 herein. It is contemplated, however, that such pneumatically operated dispensing devices would need to be modified to incorporate a heating element near the base thereof such as heating element 40 in the dispensing device 10.

Therefore, it is intended that the invention not be limited to the particular embodiment disclosed as the best mode contemplated for carrying out this invention, but that the invention will include all embodiments falling within the scope of the appended claims.

We claim:

1. The method of discharging a number of extruded beads of heated hot melt adhesive, comprising:

introducing heated hot melt adhesive into the inlet of a nozzle body;

transmitting the heated hot melt adhesive through said nozzle body to discharge outlets which eject beads of heated hot melt adhesive;

progressively decreasing the required amount of heat transferred through said nozzle body in a direction from said inlet to said discharge outlets thereof in order to minimize the difference between the temperature of the heated hot melt adhesive at said inlet and the temperature of the heated hot melt adhesive at said discharge outlets.

2. The method of discharging a number of extruded beads of heated hot melt adhesive, comprising:

introducing heated hot melt adhesive into the inlet of a nozzle body;

transmitting the heated hot melt adhesive through said nozzle body to discharge outlets which eject beads of heated hot melt adhesive;

progressively decreasing the required heat transfer through said nozzle body from said inlet to the extremities of said nozzle body in order to minimize the difference between the temperature of the heated hot melt adhesive at said inlet and the temperature of the heated hot melt adhesive at said discharge outlets.

3. A nozzle for ejecting an extruded bead of heated hot melt adhesive, comprising:

a nozzle body having an adhesive inlet adapted to receive heated hot melt adhesive;

said nozzle body being formed with an internal distribution passageway connected to said inlet for transmitting heated hot melt adhesive;

said nozzle body being formed with at least one discharge outlet connected to said distribution passageway for ejecting an extruded bead of adhesive;

said nozzle body including means for progressively requiring less heat to be transferred therethrough in the course of passage of the not melt adhesive from said adhesive inlet to said discharge outlet to minimize the temperature differential between the heated hot melt adhesive at said inlet of said nozzle body and the heated not melt adhesive at said discharge outlet of said nozzle body.

4. The nozzle of claim 3 in which said adhesive inlet has a diameter of about 0.040 inches.

5. The nozzle of claim 3 in which said nozzle body is formed with less than four discharge outlets, said distribution passageway having a diameter of about 0.040 inches.

6. The nozzle of claim 3 in which said nozzle body is formed with four or more discharge outlets, said distribution passageway having a diameter of about 0.060 inches.

7. The nozzle of claim 3 in which said means for progressively requiring less heat to be transferred through said nozzle body, comprises:

a top wall formed in said nozzle body, said top wall extending from a center portion of said nozzle body and having opposed end portions and length and width dimensions;

a bottom wall having a width dimension which is less than said width dimension of said top wall;

a pair of side walls extending between said top wall and said bottom wall, at least one of said side walls tapering inwardly in a direction toward the other of said side walls.

8. The nozzle of claim 7 in which said top wall tapers from said center portion of said nozzle body to each of said end portions thereof in a direction downwardly toward said bottom wall of said nozzle body.

9. The nozzle of claim 7 in which at least a portion of each of said side walls tapers inwardly in a direction toward one another between said top wall and said bottom wall.

10. The nozzle of claim 7 in which said adhesive inlet extends from said top wall of said nozzle body in a direction toward said bottom wall, and said at least one discharge outlet extends to said bottom wall of said nozzle body, said internal distribution passageway interconnecting said adhesive inlet with said at least one discharge outlet.

11. A nozzle for ejecting extruded beads of heated, hot melt thermoplastic adhesive, comprising:

a nozzle body having a top wall, a bottom wall and a pair of side walls extending between said top and bottom walls;

said nozzle body being formed with an internal adhesive flow path having an inlet at said top wall adapted to receive heated hot melt adhesive and a number of discharge outlets at said bottom wall which discharge extruded adhesive beads;

said walls of said nozzle body being formed in a configuration such that progressively less heat is required to be transferred therethrough in the course of passage of the hot melt adhesive from said inlet, along said internal adhesive flow path to said discharge outlets, whereby the difference between the temperature of the heated hot melt adhesive at said inlet in said top wall of said nozzle body and the temperature of the heated hot melt adhesive at said discharge outlets in said bottom wall of said nozzle body is minimized.

12. The nozzle of claim 11 in which said nozzle body is formed with a mounting plate, said nozzle plate being adapted to mount to the body of an adhesive dispenser.

13. The nozzle of claim 11 in which said adhesive flow path includes an internal distribution passageway interconnecting said inlet and said outlets.

14. The nozzle of claim 13 in which said nozzle body is formed with less than four discharge outlets, said distribution passageway having a diameter of about 0.040 inches.

15. The nozzle of claim 13 in which said nozzle body is formed with four or more discharge outlets, said distribution passageway having a diameter of about 0.060 inches.

16. The nozzle of claim 11 in which said nozzle body has a center potion, said top wall extending outwardly from said center portion to opposed end portions, said top wall having a width dimension which is greater than the width dimension of said bottom wall.

17. The nozzle of claim 16 in which at taper is formed in said nozzle body which extends in a downward direction toward said bottom wall from the center portion of said nozzle body to said end portions of said top wall.

18. The nozzle of claim 16 in which a taper is formed in said nozzle body which extends from a location along at least one of said side walls to said bottom wall.

19. The nozzle of claim 16 in which a taper is formed in said nozzle body which extends from a location along each of said side walls to said bottom wall.

20. An adhesive dispensing device having a nozzle for dispensing a number of spaced, extruded beads of heated hot melt adhesive, comprising:

a dispenser body having an adhesive passageway for transmitting heated hot melt adhesive, an adhesive discharge outlet for ejecting adhesive and means movable with respect to said adhesive discharge outlet between an open position for permitting the discharge of adhesive therethrough, and a closed position for preventing the discharge of adhesive therethrough;

a nozzle having a nozzle body including a mounting plate, said mounting plate having means for connecting said nozzle to said dispenser body;

said nozzle body being formed with an adhesive inlet which communicates with said adhesive discharge outlet of said dispenser body for receiving heated hot melt adhesive therefrom;

said nozzle body being formed with an internal distribution passageway connected to said inlet for transmitting heated hot melt adhesive;

said nozzle body being formed with at least one discharge outlet connected to said distribution passageway for ejecting an extruded bead of adhesive;

said nozzle body including means for progressively requiring less heat to be transferred therethrough in the course of passage of the hot melt adhesive from said inlet to said discharge outlet to minimize the temperature differential between the heated hot melt adhesive at said inlet of said nozzle body and the heated not melt adhesive at said at least one discharge outlet of said nozzle body.

21. The adhesive dispensing device of claim 20 in which said dispenser body includes a heating element located near said adhesive discharge outlet therein for heating the hot melt adhesive transmitted through said adhesive passageway, said mounting plate being connected to said dispenser body proximate said heating element to enhance the transfer of heat therebetween.

22. The adhesive dispensing device of claim 20 in which said dispenser body includes an extension formed with said adhesive discharge outlet, said mounting plate of said nozzle being formed with a bore which receives said extension so that said adhesive discharge outlet of said extension is connected to said inlet of said nozzle body.

23. The adhesive dispensing device of claim 22 in which said nozzle body is formed with an annular slot at the base of said throughbore in said mounting plate, said slot mounting an O-ring in position to engage said extension of said dispenser body to form a seal therebetween.

24. The nozzle of claim 20 in which said means for progressively requiring less heat to be transferred through said nozzle body, comprises:

a top wall formed in said nozzle body, said top wall extending from a center portion of said nozzle body and having opposed end portions and length and width dimensions;

a bottom wall having a width dimension which is less than said width dimension of said top wall;

a pair of side walls extending between said top wall and said bottom wall, at least one of said side walls tapering inwardly in a direction toward the other of said side walls.

25. The nozzle of claim 24 in which at least a portion of each of said side walls tapers inwardly in a direction toward one another and said bottom wall.

26. The nozzle of claim 24 in which said top wall tapers from said center portion of said nozzle body to each of said end portions thereof in a direction downwardly toward said bottom wall of said nozzle body.

27. The nozzle of claim 24 in which said adhesive inlet extends from said center portion of said nozzle body in a direction toward said bottom wall, and said at least one discharge outlet extends to said bottom wall of said nozzle body, said internal distribution passageway interconnecting said adhesive inlet with said at least one discharge outlet.

* * * * *